US007357184B2

(12) United States Patent
Patton et al.

(10) Patent No.: US 7,357,184 B2
(45) Date of Patent: Apr. 15, 2008

(54) JACKING FRAME HAVING A WELLHEAD CENTRALIZER AND METHOD OF USE

(75) Inventors: Bart Patton, Sugar Land, TX (US); Yarom Polsky, Albuquerque, NM (US)

(73) Assignee: Schlumberger Technology Corporation, Sugar Land, TX (US)

( * ) Notice: Subject to any disclaimer, the term of this patent is extended or adjusted under 35 U.S.C. 154(b) by 169 days.

(21) Appl. No.: 11/300,258

(22) Filed: Dec. 14, 2005

(65) Prior Publication Data

US 2007/0089883 A1 Apr. 26, 2007

Related U.S. Application Data

(60) Provisional application No. 60/729,270, filed on Oct. 21, 2005.

(51) Int. Cl.
*E21B 19/22* (2006.01)

(52) U.S. Cl. ..... 166/341; 166/343; 166/360; 166/355

(58) Field of Classification Search ..... 166/355, 166/77.2, 77.3, 341, 343, 360, 85.5
See application file for complete search history.

(56) References Cited

U.S. PATENT DOCUMENTS

| | | | | |
|---|---|---|---|---|
| 4,421,173 | A | 12/1983 | Beakley et al. | |
| 4,901,805 | A | 2/1990 | Ali-Zade | |
| 5,704,427 | A * | 1/1998 | Buck et al. | 166/338 |
| 6,000,480 | A | 12/1999 | Eik | |
| 6,260,625 | B1 * | 7/2001 | Phan et al. | 166/355 |
| 6,554,075 | B2 | 4/2003 | Fikes et al. | |
| 6,688,814 | B2 | 2/2004 | Wetch et al. | |
| 6,763,890 | B2 | 7/2004 | Polsky et al. | |
| 6,973,979 | B2 * | 12/2005 | Carriere et al. | 175/203 |
| 2003/0221822 | A1 | 12/2003 | Polsky et al. | |
| 2004/0151549 | A1 | 8/2004 | Roodenburg et al. | |
| 2005/0211430 | A1 | 9/2005 | Patton et al. | |

FOREIGN PATENT DOCUMENTS

| | | |
|---|---|---|
| GB | 2053318 | 2/1981 |
| GB | 2334048 | 8/1999 |
| GB | 2343466 | 5/2000 |
| GB | 2418684 | 4/2006 |

* cited by examiner

*Primary Examiner*—David J. Bagnell
*Assistant Examiner*—Sean D Andrish
(74) *Attorney, Agent, or Firm*—Rodney Warfford; David Cate; Robin Nava

(57) ABSTRACT

A jacking frame for an oil well offshore platform is provided that includes a support structure; a coiled tubing injector supported by the support structure and having a longitudinal axis; and a centralizer attached to the support structure, which moves a wellhead of the platform into alignment with the longitudinal axis of the coiled tubing injector.

14 Claims, 4 Drawing Sheets

JACKING FRAME HAVING A WELLHEAD CENTRALIZER AND METHOD OF USE

CROSS-REFERENCE TO RELATED APPLICATION

This application claims priority under 35 U.S.C. §119(e) to U.S. Provisional Application Ser. No. 60/729270, filed on Oct. 21, 2005, which is incorporated herein by reference.

FIELD OF THE INVENTION

The present invention relates generally to a jacking frame for supporting a coiled tubing injector, and particularly to such a jacking frame having a centralizer for moving a wellhead into alignment with a longitudinal axis of the coiled tubing injector.

BACKGROUND

Wellheads on TLP platforms can exhibit horizontal offsets due to platform movement. This movement tends to cause the wellheads to be located off of well center. Rigging up coiled tubing onto a wellhead that is not on well center can cause undo stress on the wellhead and/or riser sections extending therefrom. This stress is caused by the wellhead attempting to move back through well center as the platform position or currents change.

Typically, jacking frames are initially positioned on a platform based on the location of the wellhead at that time. This is achieved by physically moving the entire frame into alignment with the instantaneous wellhead position. Such a procedure is time consuming and requires sophisticated and/or large equipment due to the relatively large overall weight of the jacking frame.

In addition, the wellhead is likely to move during a coiled tubing operation, and may not be aligned with the jacking frame after a few hours of operation. An example of such a movement often occurs during a coiled tubing tool change. During a tool change the coiled tubing injector is disengaged from the wellhead. While the wellhead is disengaged from the coiled tubing, it often moves off of well center due to platform movements or currents, among other outside forces. If the wellhead moves off of well center, and a conventional jacking frame is in use, then the jacking frame must again be physically moved into alignment with the wellhead to reconnect the coiled tubing, and its new tool, to the wellhead.

As such, in order to minimize stress on the wellhead and/or riser sections it is desirable for the wellhead to be located on well center, such that when the coiled tubing equipment is disposed over well center, the wellhead and the coiled tubing equipment are in alignment. Accordingly, a need exists for a jacking frame having a centralizer system capable of moving and/or holding a wellhead on well center.

SUMMARY

In one embodiment, the present invention is a jacking frame for an oil well offshore platform that includes a support structure; a coiled tubing injector supported by the support structure and having a longitudinal axis; and a centralizer attached to the support structure, which moves a wellhead of the platform into alignment with the longitudinal axis of the coiled tubing injector.

In another embodiment, the present invention is an offshore drilling platform that includes a wellhead having a riser extending therefrom, and a jacking frame. The jacking frame includes a support structure; a coiled tubing injector supported by the support structure and having a longitudinal axis disposed in alignment with a well center; and a centralizer attached to the support structure and movable into contact with the wellhead riser to move the wellhead into alignment with both the longitudinal axis of the coiled tubing injector and the well center.

In yet another embodiment, the present invention is a method of aligning an oil well offshore platform wellhead with both a longitudinal axis of a coiled tubing injector and a well center including positioning a support structure, which supports the coiled tubing injector, on the platform such that the longitudinal axis of the coiled tubing injector is aligned with the well center; and activating a centralizer of the support structure to move the wellhead into alignment with both the longitudinal axis of the coiled tubing injector and the well center.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

As shown in FIGS. 1-7, embodiments of the present invention are directed to a jacking frame having a wellhead centralizer. In general, a jacking frame (as used herein) is any structure which supports a coiled tubing injector during an oil field coiled tubing operation The wellhead centralizer allows the jacking frame to be mounted, or otherwise positioned, on a drilling platform such that a longitudinal axis of the coiled tubing injector is in alignment with theoretical well center. The centralizer may then be used to move and/or hold the wellhead into alignment with the well center, and therefore also into alignment with the longitudinal axis of the coiled tubing injector. The stresses associated with the wellhead being located off of well center are therefore eliminated.

Figure 1:
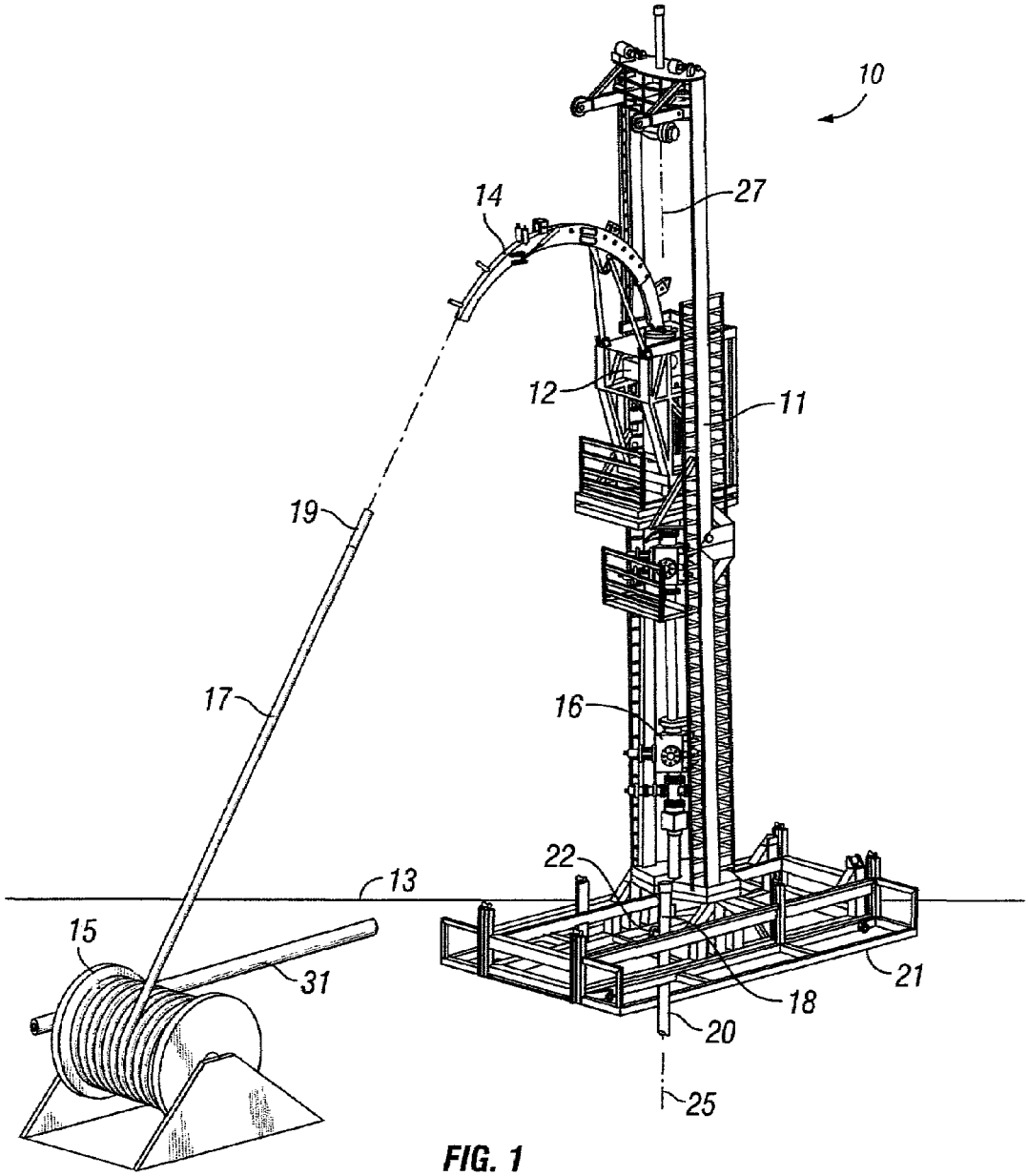
FIG. 1 is perspective view of a jacking frame having a wellhead centralizer according to one embodiment of the present invention.

FIG. 1 shows a jacking frame 10, according to one embodiment of the present invention, disposed on an offshore drilling platform 13. As shown, the jacking frame 10 includes a support structure 11, which supports a coiled tubing injector 12, and a base 21 supported by the platform 13. Forming a portion of the coiled tubing injector 12 is a gooseneck 14, which guides a coiled tubing string 17 from a spool 15 to the injector 12. Attached to the coiled tubing string 17 is a tool 19 for performing a specific oil field operation.

Typically, an upper portion of a blow out preventer 16 is attached to a riser extending from the coiled tubing injector 12, and a lower portion of the blow out preventer 16 is attached to another riser 18, which extends upwardly from the wellhead 20. Note, however, that in FIG. 1 the wellhead riser 18 is detached from the blow out preventer 16 for clarity to show how a misalignment between the wellhead riser 18 and the blow out preventer 16 can be corrected by the current invention, which is discussed in detail below.

In the depiction of FIG. 1, the jacking frame 10 has been positioned on the platform 13 such that a longitudinal axis 27 of the riser attached the coiled tubing injector 12 (and hence the longitudinal axis of the injector 12 itself) is in alignment with well center 25. As such, the blow out preventer 16, which is attached to the coiled tubing injector 12, is also shown in alignment with well center 25. The wellhead 20 and the wellhead riser 18, on the other hand, is shown misaligned or horizontally offset from the longitudinal axis 27 of the coiled tubing injector 12. A centralizer 22, attached to the jacking frame support structure 11, is used to correct this misalignment.

Figure 2:
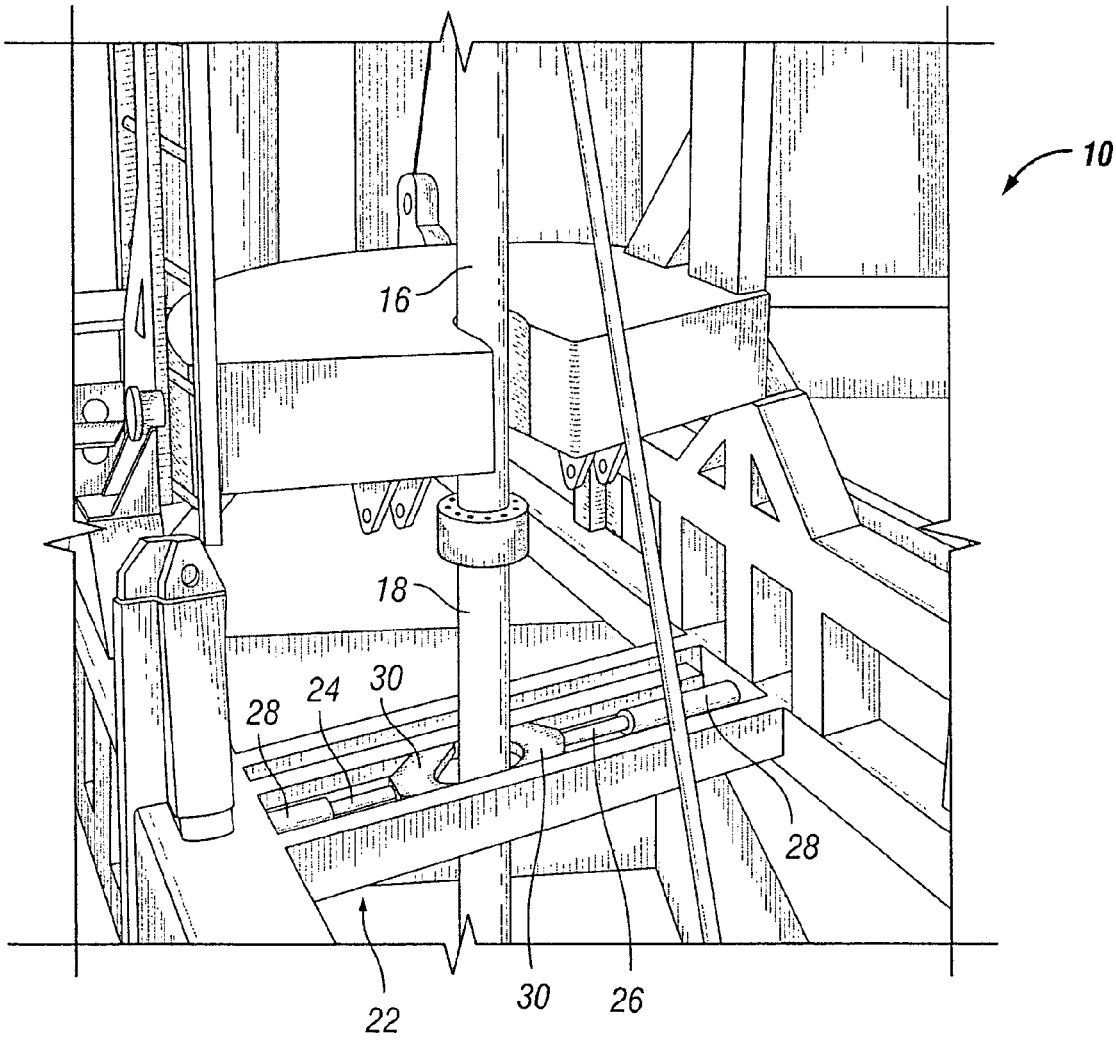
FIG. 2 is an enlarged perspective view of a portion of FIG. 1, after the centralizer has moved a wellhead on well center.
Figure 3:
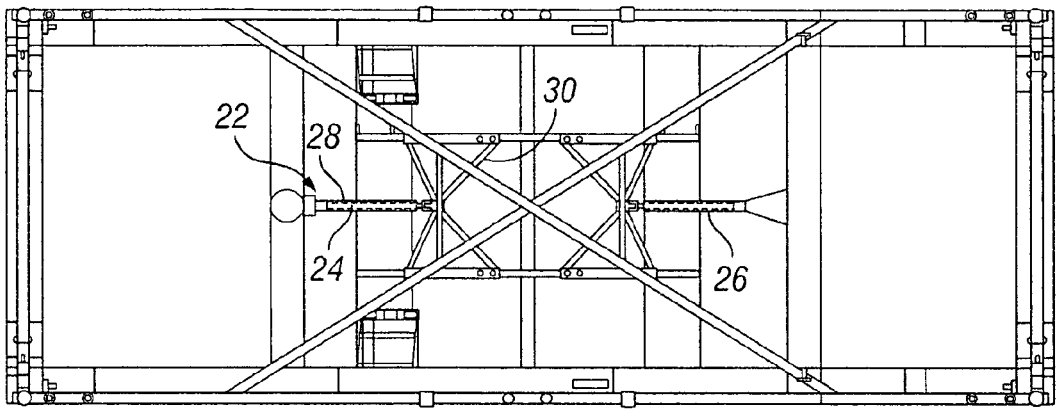
FIG. 3 is a top view of the centralizer of FIG. 1.

As shown enlarged in FIG. 2, the centralizer 22 includes a first arm 24 and a second arm 26 each movable into contact with the wellhead riser 18. The arms 24 and 26 are pre-positioned such that their contact with the wellhead riser 18 causes both the wellhead riser 18, and the wellhead 20, attached thereto, to move into alignment with well center 25. Note that FIG. 2 shows the wellhead riser 18 disposed in alignment with and connected to the blow out preventer 16. Thus connected, the wellhead 20 is in alignment with the longitudinal axis of the coiled tubing injector 12.

In one embodiment, each arm 24 and 26 of the centralizer 22 includes a hydraulic cylinder 28 with a hand 30 attached thereto. Each hydraulic cylinder 28 may be actuated to move the centralizer hands 30 into and out of contact with the wellhead riser 18 to move the wellhead riser 18, and hence the wellhead 20, as desired. Note that although FIG. 2 show hydraulic cylinders, other means of moving the centralizer arms are contemplated by the current invention, such as a rack and pinion system, an electric motor, among other appropriate moving means.

As shown in FIG. 3 and 5-7, in one embodiment the centralizer hands 30 are V-shaped. This aids in guiding the wellhead riser 18 when the hands 30 come into contact with the wellhead riser 18, as each side of the V-shape acts as a ramp which guides the wellhead riser 18 toward the center of the V-shape. This is illustrated by viewing FIGS. 5-6 in combination.

Figure 5:
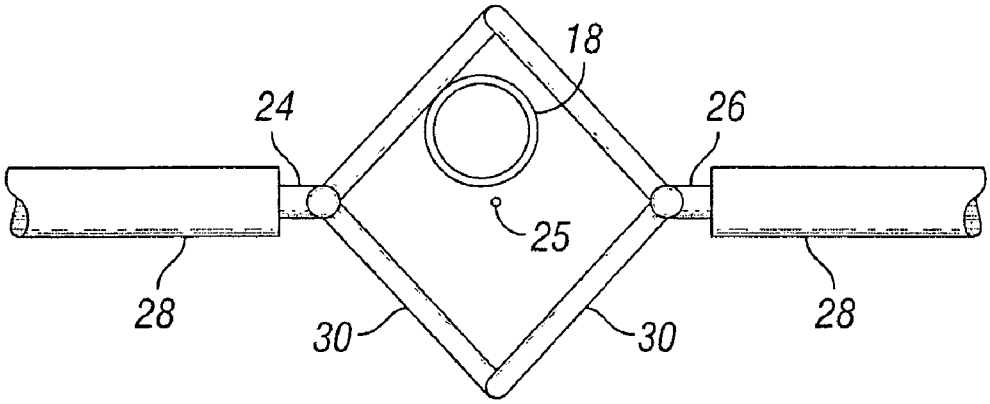
FIG. 5 is an enlarged top view of the centralizer of FIG. 3, shown in engagement with a wellhead pipe that is disposed off well center.
Figure 6:
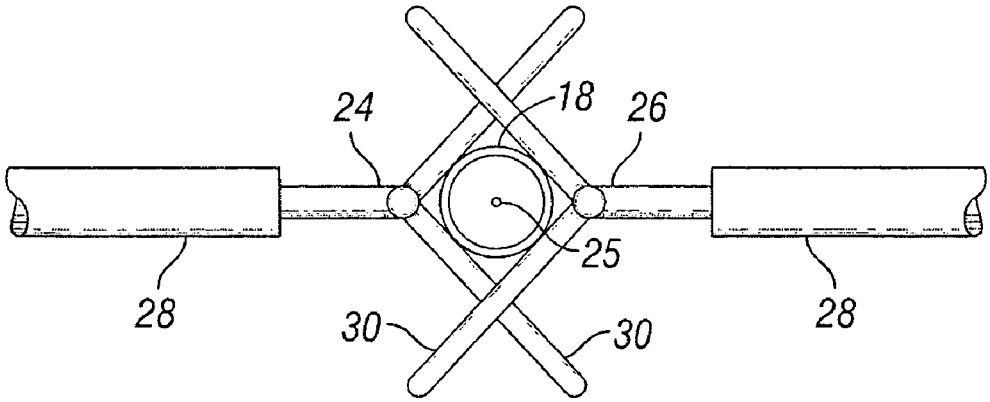
FIG. 6 shows the centralizer of FIG. 5 holding the wellhead pipe in alignment with the well center.

In FIG. 5, the wellhead riser 18 is offset from the well center 25. In this depiction, the wellhead riser 18 is in contact with outer ends of the centralizer hands 30. As the arms 24 and 26 move toward each other, the V-shape of the hands 30 move or guide the wellhead riser 18 toward the center of the V-shape. As shown in FIG. 6, when the wellhead riser 18 is centered with respect to and in contact with both V-shaped hands 30, the wellhead riser 18, and hence the wellhead 20, is aligned with well center 25.

Figure 4:
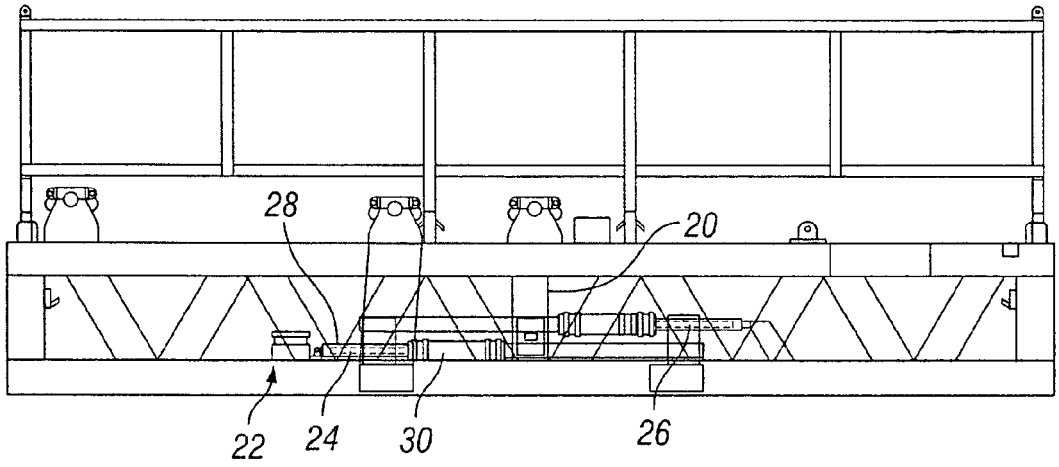
FIG. 4 is a side view of the centralizer of FIG. 3.
Figure 7:
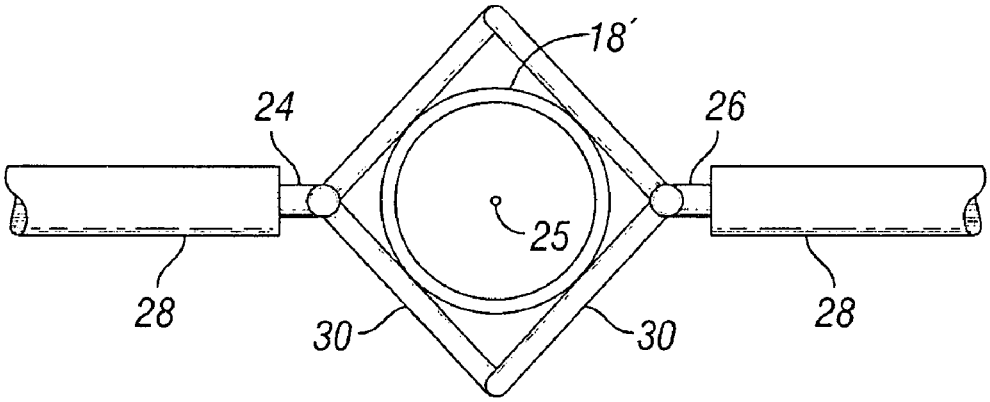
FIG. 7 shows the centralizer of FIG. 5 in engagement with a wellhead pipe having a different diameter than the wellhead pipe of FIG. 5.

FIG. 4 shows a side view of the centralizer 22. As shown, in one embodiment the hydraulic cylinder rods (arms) 24 and 26 are positioned such that each hydraulic cylinder 28 moves its corresponding hand 30 in a horizontal direction. As is also shown, the hydraulic cylinder rods (arms) 24 and 26 are vertically offset from one another. This allows the centralizer hands 30 to overlap in the vertical direction, enabling the hands 30 to move wellhead risers 18 of varying diameters. For example, FIG. 6 shows the hands 30 in contact with a wellhead riser 18 having a first diameter, and FIG. 7 shows the hands 30 in contact with a wellhead riser 18' having a second diameter, which is smaller than the diameter of the wellhead riser 18 of FIG. 6.

In one embodiment according to the present invention, the jacking frame 10 is mounted, or otherwise positioned such that the longitudinal axis 27 of the coiled tubing injector 12 supported thereon is in alignment with the well center 25. As such, when the centralizer 22 moves the wellhead 20 into alignment with well center 25, as described above, the wellhead 20 is also in alignment with the longitudinal axis 27 of the coiled tubing injector 12.

The centralizer 22 may also be used to aid in making connections when it is desired to remove the coiled tubing tool 19 from the coiled tubing string 17, and attach a new tool 31 to the coiled tubing string 17. When such a tool change is desired, the centralizer 22 is activated or otherwise moved into contact with the wellhead riser 18 to hold it in alignment with the well center 25. With the centralizer 22 thus activated, typically the coiled tubing injector 12 is disconnected from the blow out preventer 16 to expose the coiled tubing tool 19. Even when thus disconnected, the coiled tubing injector 12 remains aligned with well center 25 since the jacking frame 10 was initially positioned to aligned the longitudinal axis 27 of the coiled tubing injector 12 with well center 25. The coiled tubing tool 19 may then be removed from the coiled tubing string 17 and replaced by the new tool 31. The coiled tubing injector 12 is then reconnected with the blow out preventer 16, and the assembly is reconnected in alignment with the both the wellhead 20 and well center 25. With these connections reestablished, the centralizer may be deactivated or otherwise moved from contacting the wellhead riser 18.

Using the above described method, the wellhead 20 never leaves the well center position, and therefore the jacking frame 10 does not need to be physically moved between tool changes as was a problem with previous jacking frames.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, spirit and scope of this invention. Accordingly, the foregoing description should not be read as pertaining only to the precise structures described and shown in the accompanying drawings, but rather should be read as consistent with and as support for the following claims, which are to have their fullest and fairest scope. Also, note that the coiled tubing spool 15, the coiled tubing 17, the coiled tubing tool 19, and the coiled tubing replacement tool 31 are each shown schematically in FIG. 1.

The invention claimed is:

1. A jacking frame for an oil well offshore platform comprising:

a support structure;

a coiled tubing injector supported by the support structure and having a longitudinal axis; and a centralizer attached to the support structure, which moves a wellhead of the platform into alignment with the longitudinal axis of the coiled tubing injector.

2. The jacking frame of claim 1, wherein the centralizer comprises at least one moveable arm comprising a hand which moves the wellhead into alignment with the longitudinal axis of the coiled tubing injector.

3. The jacking frame of claim 1, wherein the centralizer comprises two moveable arms, each comprising a hand which moves the wellhead into alignment with the longitudinal axis coiled tubing injector.

4. The jacking frame of claim 3, wherein each hand is V-shaped hand to facilitate moving the wellhead into alignment with the longitudinal axis of the coiled tubing injector.

5. The jacking frame of claim 3, wherein the moveable arms are vertically offset from one another.

6. The jacking frame of claim 5, wherein each moveable arm comprises a hydraulic cylinder.

7. An offshore drilling platform comprising:

a wellhead having a riser extending therefrom; and a jacking frame comprising:

a support structure, a coiled tubing injector supported by the support structure and having a longitudinal axis disposed in alignment with a well center, and a centralizer attached to the support structure and movable into contact with the wellhead riser to move the wellhead into alignment with both the longitudinal axis of the coiled tubing injector and the well center.

8. The jacking frame of claim 7, wherein the centralizer comprises at least one moveable arm comprising a hand which is movable into contact with the wellhead riser to move the wellhead into alignment with both the longitudinal axis of the coiled tubing injector and the well center.

9. The jacking frame of claim 7, wherein the centralizer comprises two moveable arms, each comprising a hand which is movable into contact with the wellhead riser to move the wellhead into alignment with both the longitudinal axis of the coiled tubing injector and the well center.

10. The jacking frame of claim 9, wherein each hand is V-shaped hand to facilitate guiding the wellhead into alignment with both the longitudinal axis of the coiled tubing injector and the well center.

11. The jacking frame of claim 9, wherein the moveable arms are vertically offset from one another.

12. The jacking frame of claim 11, wherein each moveable arm comprises a hydraulic cylinder.

13. A method of aligning an oil well offshore platform wellhead with both a longitudinal axis of a coiled tubing injector and a well center comprising:

positioning a support structure, which supports the coiled tubing injector, on the platform such that the longitudinal axis of the coiled tubing injector is aligned with the well center; and activating a centralizer of the support structure to move the wellhead into alignment with both the longitudinal axis of the coiled tubing injector and the well center.

14. The method of claim 13, further comprising uncoupling the coiled tubing injector from the wellhead, replacing a tool held by the coiled tubing injector; and re-coupling the coiled tubing injector with the wellhead, wherein the centralizer holds the wellhead in alignment with the well center during said uncoupling, replacing and re-coupling steps.

* * * * *